US007367627B2

(12) United States Patent
Figueras Mitjans

(10) Patent No.: US 7,367,627 B2
(45) Date of Patent: May 6, 2008

(54) ARMCHAIR FOLDING SYSTEM

(75) Inventor: José Figueras Mitjans, Barcelona (ES)

(73) Assignee: Figueras International Seating, S.A. (ES)

( * ) Notice: Subject to any disclaimer, the term of this patent is extended or adjusted under 35 U.S.C. 154(b) by 0 days.

(21) Appl. No.: 10/595,688

(22) PCT Filed: Nov. 4, 2004

(86) PCT No.: PCT/ES2004/000489

§ 371 (c)(1),
(2), (4) Date: Jun. 29, 2006

(87) PCT Pub. No.: WO2005/044050

PCT Pub. Date: May 19, 2005

(65) Prior Publication Data

US 2007/0063568 A1 Mar. 22, 2007

(30) Foreign Application Priority Data

Nov. 5, 2003 (ES) ..... 200302529 U

(51) Int. Cl.
*A47C 7/54* (2006.01)

(52) U.S. Cl. ..... 297/411.2; 297/411.32; 297/335; 297/332

(58) Field of Classification Search ..... 297/411.2, 297/411.32, 332, 335, 333
See application file for complete search history.

(56) References Cited

U.S. PATENT DOCUMENTS

| | | | | |
|---|---|---|---|---|
| 3,443,835 | A * | 5/1969 | Brunskole | 297/35 |
| 4,211,450 | A * | 7/1980 | Sutter | 297/232 |
| 4,702,043 | A * | 10/1987 | Suzuki | 52/9 |
| 5,653,502 | A * | 8/1997 | Kimura et al. | 297/217.7 |
| 5,685,608 | A * | 11/1997 | Yamazaki | 297/335 |
| 6,217,119 | B1 * | 4/2001 | Cook et al. | 297/411.32 |
| 6,244,657 | B1 * | 6/2001 | Momose | 297/217.7 |

* cited by examiner

*Primary Examiner*—David Dunn
*Assistant Examiner*—Erika Garrett
(74) *Attorney, Agent, or Firm*—Lucas & Mercanti, LLP

(57) ABSTRACT

The invention relates to an armchair folding system. According to the invention, the seat (1) and the corresponding armrests (3) are mounted using a tilting hinge system. More specifically, each armrest (3) is mounted to a rotary shaft (4) comprising a spring (5) that is used to raise the armrest (3). Moreover, the side of the armrest (3) is equipped with an angular element (6) on which side panel pins (7) can rest, thereby producing a drag effect in relation to the tilting movement between the seat (1) and each armrest (3).

2 Claims, 6 Drawing Sheets

ARMCHAIR FOLDING SYSTEM

FIELD OF THE INVENTION

The present invention relates to the folding of armchairs in cinemas, conference halls and similar places to release as much as possible the space between rows of armchairs when these are not being used, proposing for that purpose a particular folding system based on a combination of the folding of the seats and armrests.

STATE OF THE ART

Arranging parallel rows of armchairs for the users is common in cinemas, conference halls, etc, with which a good, rational use of space is achieved.

However, said armchair arrangement in rows entails a drawback in the walk for accessing the armchairs or for cleaning, so the armchairs are generally provided with folding solutions to release the space between the rows of armchairs when these are not being used.

In this sense, solutions are known of an articulate seat arrangement, for the folding and unfolding of the latter in the respective positions of use and inoccupation, such as for example, the embodiments gathered in patents ES 209045 and ES 2011949, or in Utility Models ES 9900719 and ES 200000762, among many others, even including assemblies wherein the seat is automatically positioned in the folding position when it is unoccupied.

In the same sense, there are also articulate arrangement solutions for folding and unfolding armrests, such as for example, the embodiments described in Utility Models ES 9603260 and ES 9802263 but always with an independent arrangement for that of the seat, such that in these cases, the user must lower and raise the armrests, independently of whether he sits or rises from the seat.

OBJECTS OF THE INVENTION

According to the invention, an assembly arrangement is provided which combines the folding and unfolding of the seats and armrests of the mentioned armchairs, providing very advantageous functional features.

This arrangement object of the invention establishes an articulate assembly of each armrest and the articulate assembly of the seat independently on the respective shafts, including the assembly of a spring on each armrest tending to make the corresponding armrest tilt to the raised position or the furled position, while on the side of the armrest an element is fixed determining a perpendicular wing, the seat in turn incorporating a pin arranged to rest on said element of the armrest.

An overall assembly is thus obtained in which the articulating springs of the armrest assembly make said armrest tilt upwards automatically when the seat is empty, the armrest being dragged by this movement towards the tilting seat to the upwards folding position.

On the other hand, when a user occupies the seat, making it tilt towards the sitting position, the seat drags the corresponding armrests, making them tilt towards the operative position of its function in the armchair.

The independence between the armrests and of the latter with the seat in the assembly arrangement further makes the armrests corresponding to a seat of an armchair be in the operative using position when said seat is taken to the sitting position, without preventing an adjacent seat sharing a common intermediate armrest from being positioned in a furled position when it is unoccupied, led by the armrest of the other side of this unoccupied seat; so that the space in front of the unoccupied armchairs is completely free, facilitating the passage through said space.

Therefore, significantly advantageous features are obtained by the arrangement proposed by this invention, such that its implementation becomes feasible and with a preferred character with respect to the folding assemblies known in applied armchairs.

DETAILED DESCRIPTION OF THE INVENTION

The object of the invention is a folding arrangement for armchairs in cinemas, conference halls and the like, establishing a tilting assembly of the seat and the armrests in a functional implementation of the combination of movement between them.

According to the invention and according to the depicted embodiment, seat (1) of the armchairs is arranged in an articulated assembly on the fixed structure of the corresponding armchair by means of a shaft or points of rotation (2), whereas each armrest (3) is in turn arranged in an articulated assembly on the fixed structure of the armchair by means of a respective independent shaft (4).

Figure 1:
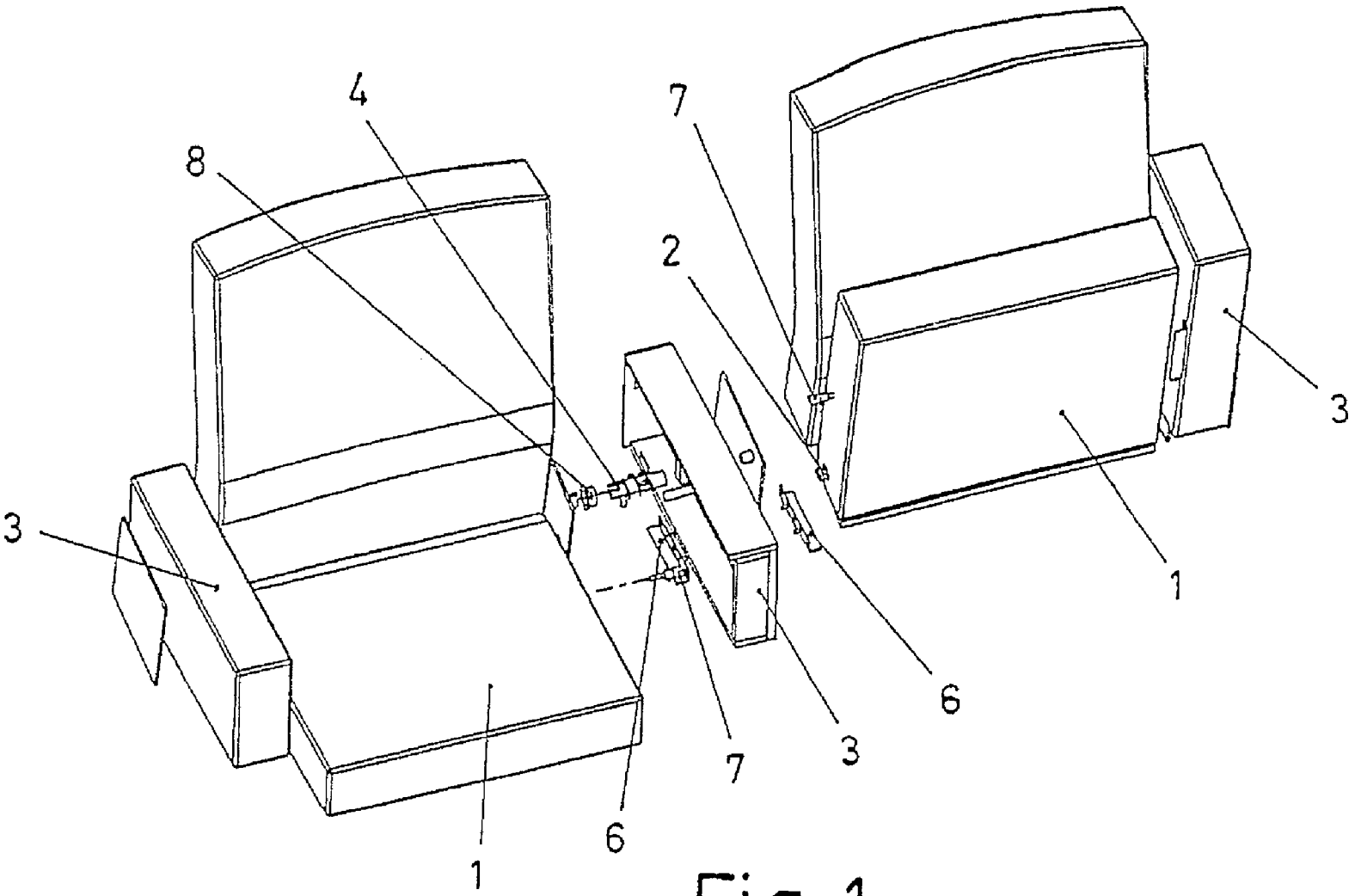
FIG. 1 shows an exploded view of the coupling between two consecutive armchairs, including an assembly according to the proposed arrangement.
Figure 2:
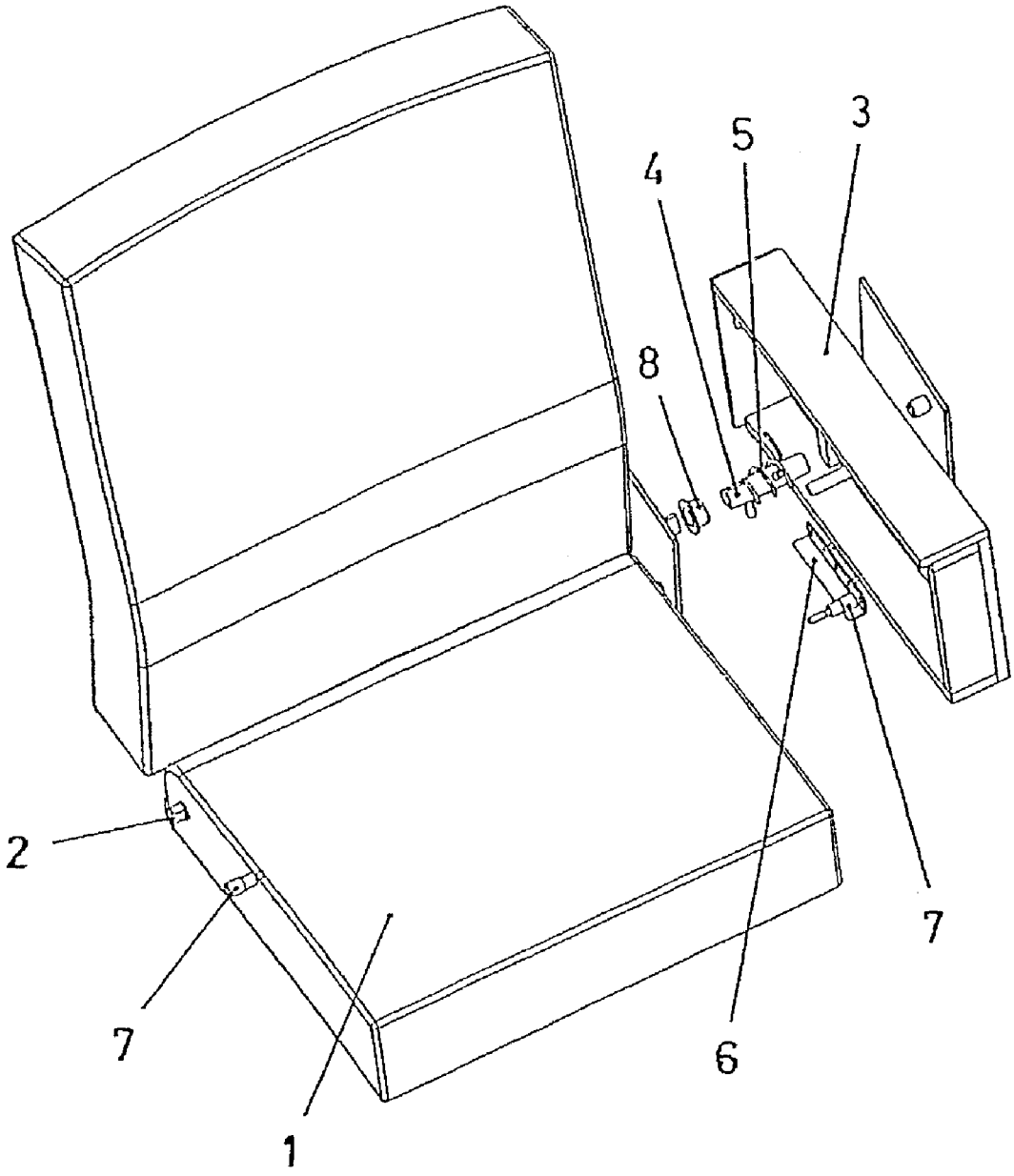
FIG. 2 shows a perspective view of the armchair according to the proposed arrangement, having eliminated one of the armrests and with the other armrest in an exploded position with respect to the assembly.
Figure 3:
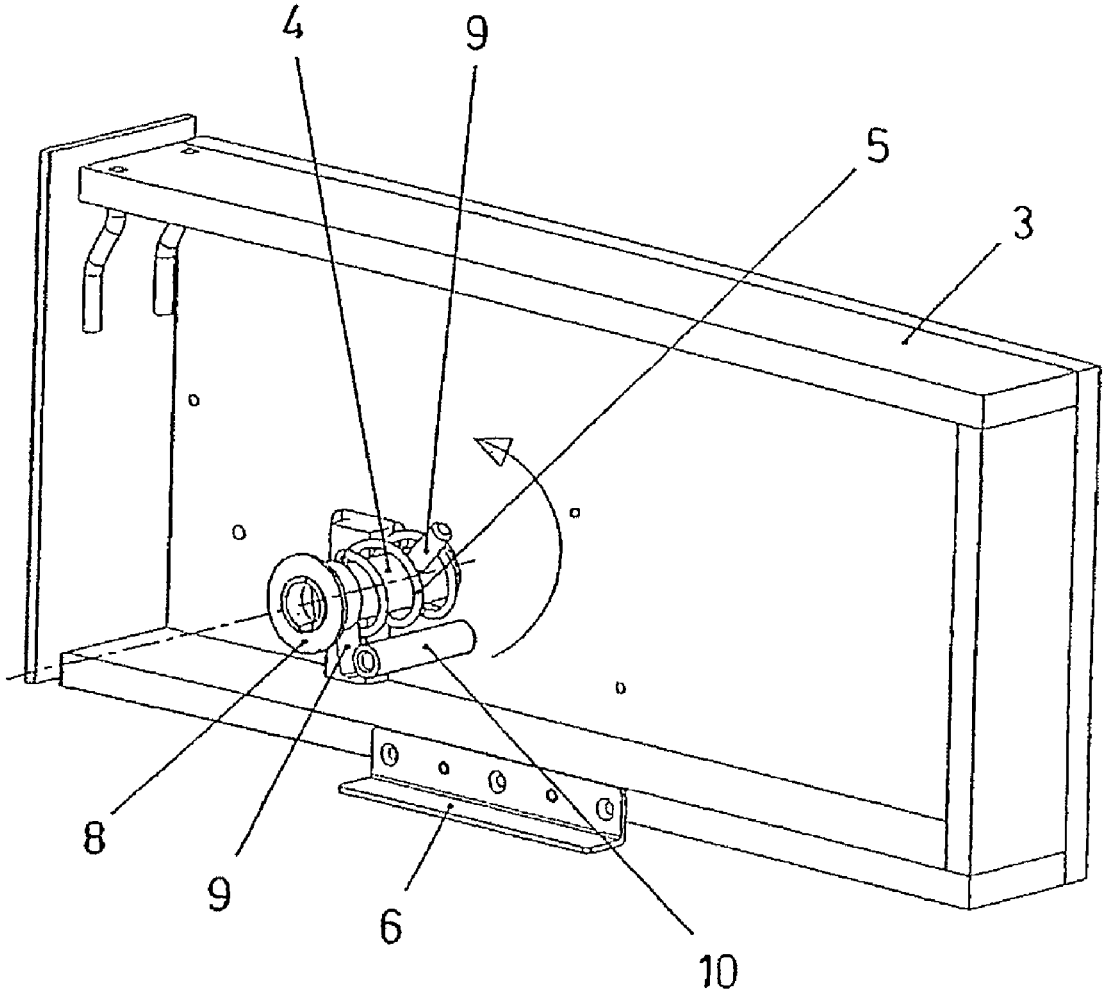
FIG. 3 is a side view of an armrest structured according to the proposed arrangement

A rotational spring (5) is incorporated on shaft (4) of the articulated assembly of each armrest (3), tending to make the respective armrest (3) tilt upwards, as shown in FIG. 3.

An angular element (6) is incorporated on the inner side of each armrest (3), the seat (1) incorporating in turn a pin (7) on each side, capable of resting, on its upper part, on the angular element (6) of the armrest (3) of the same side when seat (1) if folded downwards.

Figure 4:
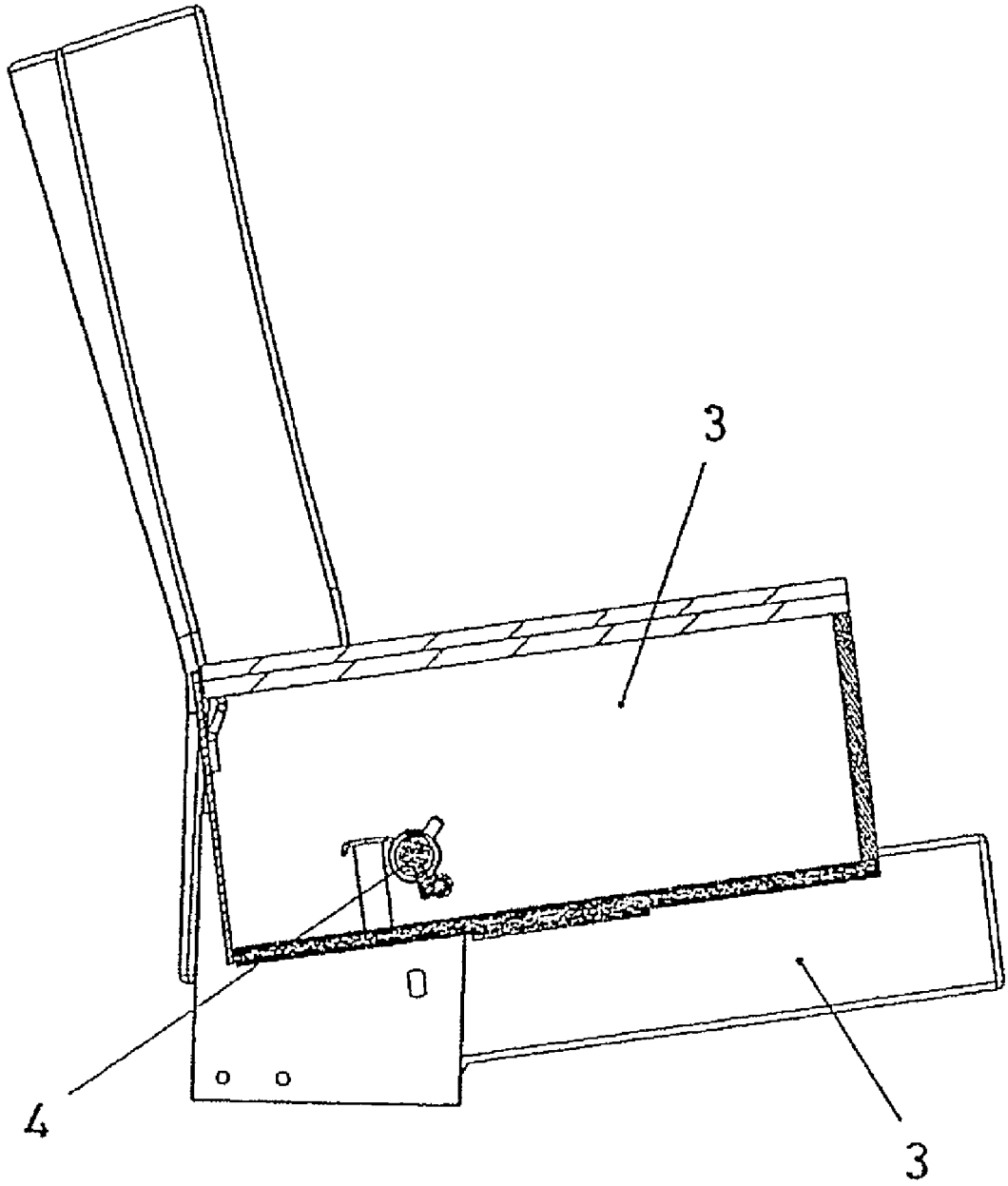
FIG. 4 is a side view of an armchair in the position for use.
Figure 6:
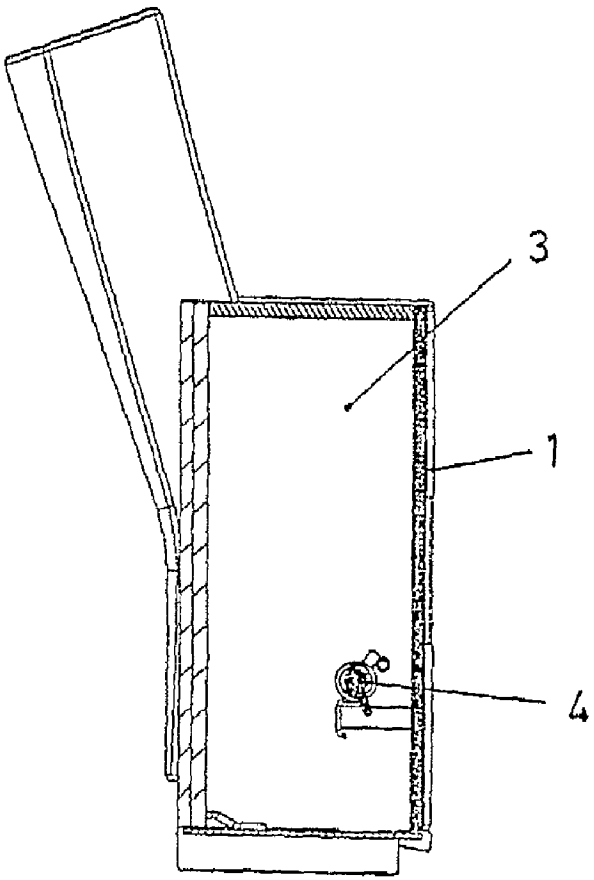
FIG. 6 is a side view of the same armchair with both the armrests and the seat in the folded position.
Figure 5:
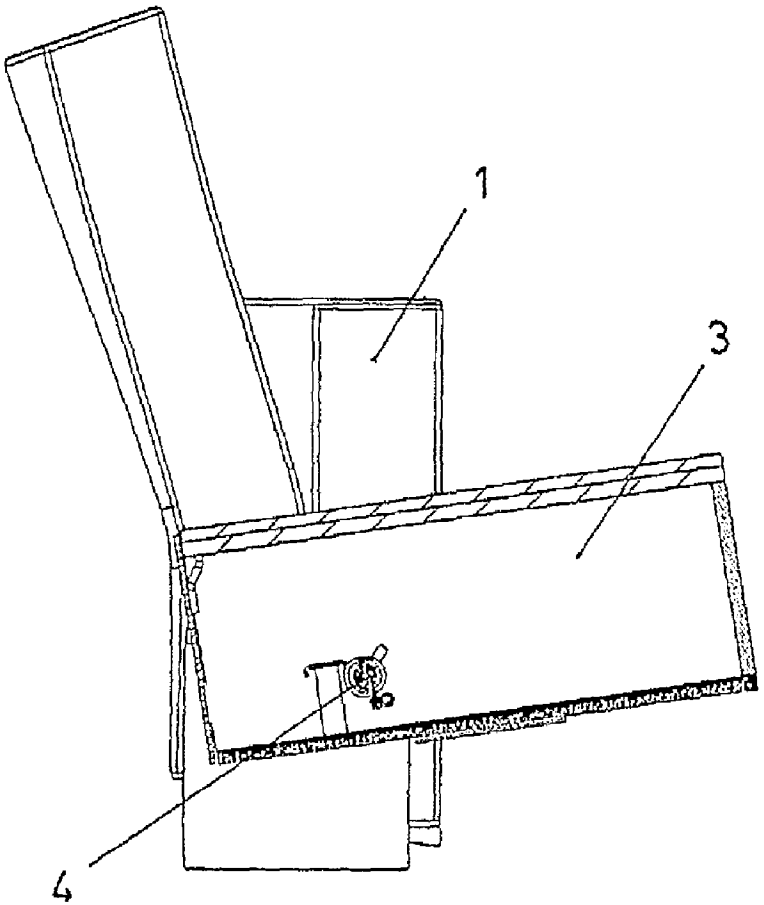
FIG. 5 is a side view of an armchair with the front armrest of the drawing sectioned an in the position for use, while the seat and the armrest of the other side are raised to the folded position.
Figure 8:
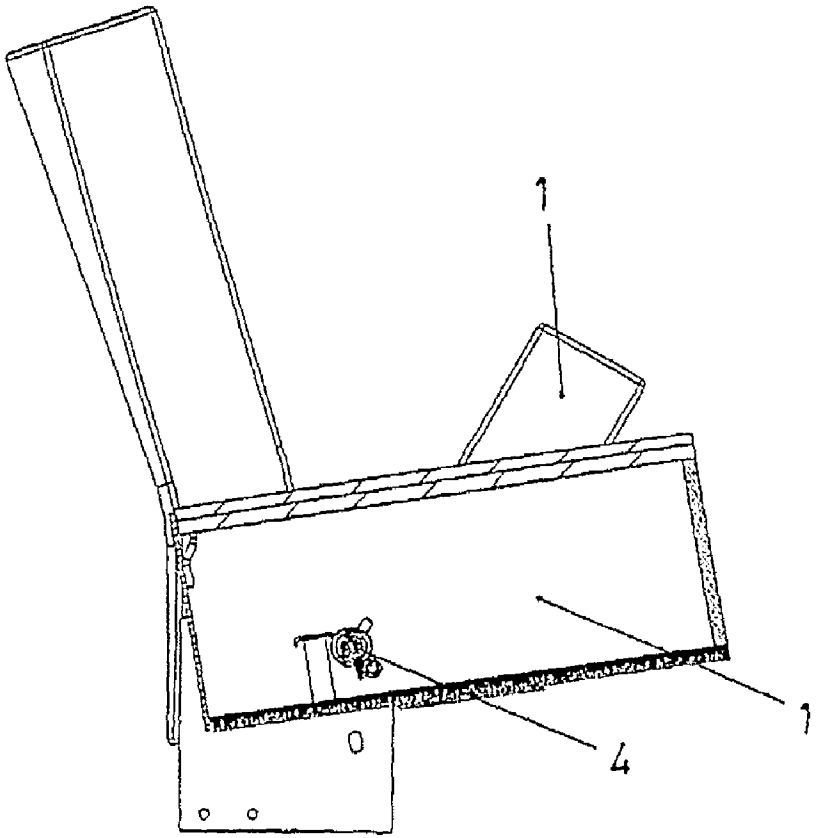
FIGS. 7 and 8 show two positions in the unfolding sequence of the armchair, from the furled position to the position for use by means of the folding of the armchair.
Figure 7:
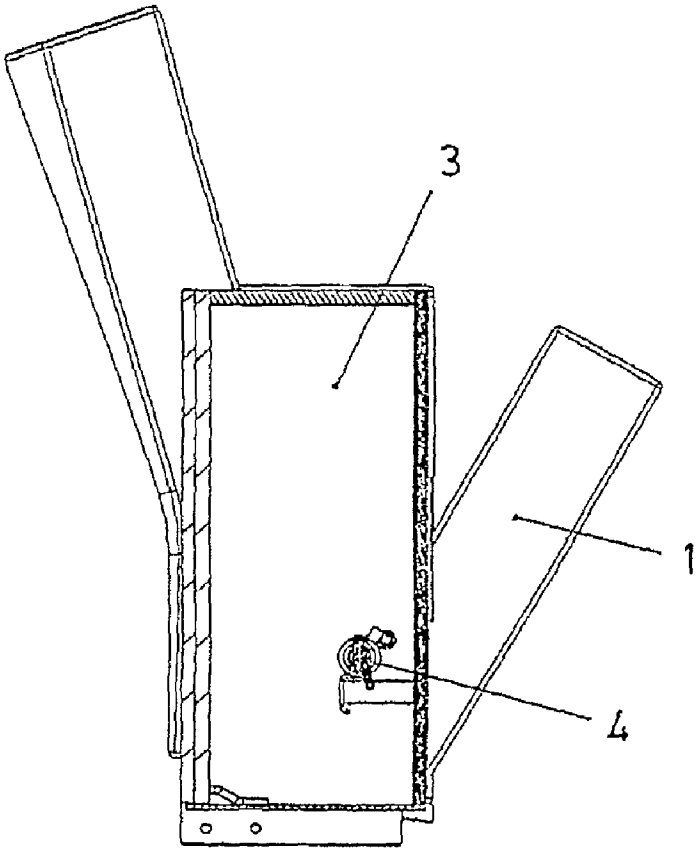

In such conditions, when seat (1) is in an unfolded position, that is arranged to be seated on, as shown in FIG. 4, the seat (1) itself, by means of the pins (7) on its sides, maintains the armrests (3) in the position for use, due to the support of said pins (7) of seat (1) on the elements (6) of the armrests.

From this position for use of the armchair, when the latter is released from supporting of the user, seat (1) tilts upwards led by the action of conventional springs incorporated in its shaft (2), while the springs (5) incorporated on the shafts (4) of the armrests (3) make these tilt upwards, such that by means of the elements (6), the armrests (3) aid in raising seat (1) in the upward tilt by means of the pins (7), the overall assembly of the armchair adopting in this way the furled folded position.

From said folded position, when seat (1) is lowered to its position for use, the seat (1) itself, by means of the pins (7) and through the respective elements (6), makes the armrests (3) also tilt to the position for use, without the user having to carry out any action on the mentioned armrests (3) of the armchair.

When the armchair is associated to other consecutive armchairs in a row of armchairs, the intermediate armrests (3) between adjacent armchairs are common to both consecutive armchairs, the independent folding of seats (1) of the respective armchairs being maintained, such that each seat (1) can tilt independently between the position for use and the folding position.

Therefore, if an armchair is occupied and the consecutive one is empty, seat (1) of the occupied armchair maintains the armrests (3) of both its sides in the unfolded position for use, while seat (1) of the unoccupied armchair is tilted upwards and maintained in the folded position by the respective armrest (3) of the side opposite to the occupied armchair, the unoccupied armchair capable of being taken, in turn, to the position for use by the unfolding of its seat (1), without any inconvenience, when another user is going to occupy it.

In the assembly, armrests (3) are arranged assembled on the corresponding shafts (4) by means of rotational bushings (8), such that shaft (4) is fixed to the armchair structure, the bushings (8) being rotated on it.

Radial rods (9) are included in the fixed shaft (4) whereas the armrest (3) has a lug (10) fixed on its structure which acts between the mentioned rods (9) in the tilting rotation of the corresponding armrest (3), with which by means of said rods (9) fixed to the articulating shaft (4) and said lug (10) fixed to the armrest (3), respective angular travel stops are established limiting the tilt of the armrest (3), preventing the spring (5) from being forced in any rotational direction.

The invention claimed is:

1. A folding arrangement in armchairs of the type comprising an articulated tilting assembly of the seat of the armchair and an articulated tilting assembly of the corresponding armrests, wherein the articulated assembly of each armrest is provided on a rotatory shaft, on which a spring is arranged acting with a tendency to maintain the armrest in an upwards tilted position, the armrest incorporating laterally an angular element, whereas seat is provided on its sides with pins capable of supporring on their upper part the angular elements of the respective armrests, wherein tilting of the seat from an inoperative position to an operative position drags the armrests from an inoperative position to an operative position, and the shaft of the assembly of the armrests is fixed to the armchair structure, the assembly of the corresponding armrest being established in free rotation on said shaft by means of rotational bushings, with the rotation being limited between the respective angular positions established by two radial rods of the shaft, on which a lug fixed to the armrest acts as a stop.

2. A folding arrangement in armchairs according to claim 1, characterized in that the armrests which are common for two adjacent armchairs are provided with angular elements in both their sides, so that movement of either of said seats of said two adjacent armchairs from an inoperative position to an operative position drags the armrest which is common to said two adjacent armchairs from an inoperative position to an operative position.

* * * * *